US006032093A

United States Patent [19]

Denbraber et al.

[11] Patent Number: 6,032,093

[45] **Date of Patent: *Feb. 29, 2000**

[54] APPARATUS AND METHOD FOR RESTRICTING IMPLEMENT MOVEMENT OF A WORK MACHINE

[75] Inventors: Lee R. Denbraber, Peoria; Mark R. Hawkins, Chillicothe; Ronald J. Penick, Henry; Steve J. Zmuda, Dunlap, all of Ill.

[73] Assignee: Caterpillar Inc., Peoria, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/682,208

[22] Filed: Jul. 17, 1996

[51] Int. Cl.[7] ..... G06F 7/00; E02F 3/00

[52] U.S. Cl. ..... 701/50; 37/348; 414/680; 414/699; 364/528.37; 364/528.38; 364/528.39

[58] Field of Search ..... 701/50; 364/528.37, 364/528.38, 528.39; 37/348, 906; 414/699, 680

[56] References Cited

U.S. PATENT DOCUMENTS

| | | | |
|---|---|---|---|
| 5,065,326 | 11/1991 | Sahm | 364/424 |
| 5,088,020 | 2/1992 | Nishida et al. | 364/160 |
| 5,160,239 | 11/1992 | Allen et al. | 414/699 |
| 5,333,533 | 8/1994 | Hosseini | 91/361 |
| 5,404,661 | 4/1995 | Sahm et al. | 37/348 |
| 5,446,980 | 9/1995 | Rocke | 37/348 |
| 5,735,066 | 4/1998 | Tochizawa et al. | 701/50 |
| 5,764,511 | 6/1998 | Henderson | 701/50 |

FOREIGN PATENT DOCUMENTS 9-078632 3/1997 Japan .

*Primary Examiner*—William A. Cuchlinski, Jr.
*Assistant Examiner*—Yonel Beaulieu

[57] ABSTRACT

A method and apparatus for controllably preventing an implement from damaging a work machine or itself, which may occur if the implement strikes the work machine, by restricting the movement of the implement. A boundary is established a predetermined distance from the work machine. By controllably restricting the movement of the implement when it approaches the boundary, the implement is prevented from making contact with the work machine.

15 Claims, 4 Drawing Sheets

NO RESTRICTION
205
200
POSITION IMPLEMENTS ≤ SECOND BOUNDARY
NO
YES
210
ENGAGE MAXIMUM IMPLEMENT SPEED
215
APPROACHING FIRST BOUNDARY
NO
YES
220
PREVENT ENTRY

APPARATUS AND METHOD FOR RESTRICTING IMPLEMENT MOVEMENT OF A WORK MACHINE

TECHNICAL FIELD

This invention relates generally to a method and apparatus for controllably restricting the movement of an implement on a work machine, and more particularly to using at least one boundary for controllably restricting the movement of an implement on a work machine.

BACKGROUND ART

Work machines having an attached implement, such as mining shovels, excavators, backhoes, motor graders, and the like, are used for moving earth. In the mining shovel example, the implement includes a boom, a stick and a bucket, or, as in the example of a motor grader, the implement includes a blade.

Currently, on track type mining shovels, it is common to see broken or damaged track shoes, or damage to the back of the bucket. This damage is due to the bucket hitting the track shoes when the operator attempts to position the bucket between the tracks. Likewise, damage to the tires of a motor grader will occur when an operator directs the blade to move prior to turning the tires out of the path of the blade. In both examples, the movement of the implement causes damage to either itself, the work machine, or both.

It is undesirable to limit the flexibility of an implement by mechanically limiting its range of motion. Although this would prevent the damage from occurring, it would severely limit the functionality of the work machine.

Currently, only the skill of the work machine operator prevents the implement from striking the work machine. In the normal operation of a work machine many events are occurring simultaneously. This increases the potential for operator error, including the risk of allowing the implement to strike the work machine.

The present invention is directed to overcoming one or more of the problems as set forth above.

DISCLOSURE OF THE INVENTION

In one aspect of the present invention, a method for controlling the movement of an implement relative to a work machine is provided. The implement is connected to the work machine. Included in the work machine is an operator control device. A controller, which is associated with the operator control device, produces a desired position signal and delivers it to the implement. A boundary relative to the work machine is established. The sensed position of the implement is compared to the boundary location. The controller determines from the comparison when the implement is approaching the boundary and modifies the desired position signal accordingly. In response to the modified desired position signal, the implements movement is restricted in a predetermined manner.

In a second aspect of the present invention, an apparatus for controllably restricting the movement of an implement connected to a work machine is provided. The work machine includes an operator control device connected to a controller, adapted to deliver a desired position signal to the implement. A first boundary, having its values stored in a memory associated with the controller, is established at a predetermined distance from at least a portion of the work machine. At least one displacement sensor associated with the implement is adapted to deliver an implement position signal to the controller. The controller is adapted to deliver a modified desired position signal to the implement, dependent on the difference between the implement position signal and the first boundary value.

BRIEF DESCRIPTION OF THE DRAWINGS

For a better understanding of the invention, reference may be made to the accompanying drawings, in which.

BEST MODE FOR CARRYING OUT THE INVENTION

The present invention provides an apparatus to controllably restrict the movement of an implement 10 connected to a work machine 15.

The following description uses a track type mining shovel as an example only. This invention can be applied to other types of work machines 15 having an implement 10. Other examples include a motor grader having an implement 10 in the form of a blade, and a back hoe, having an implement 10 in the form of an impact rock ripper.

Figure 1:
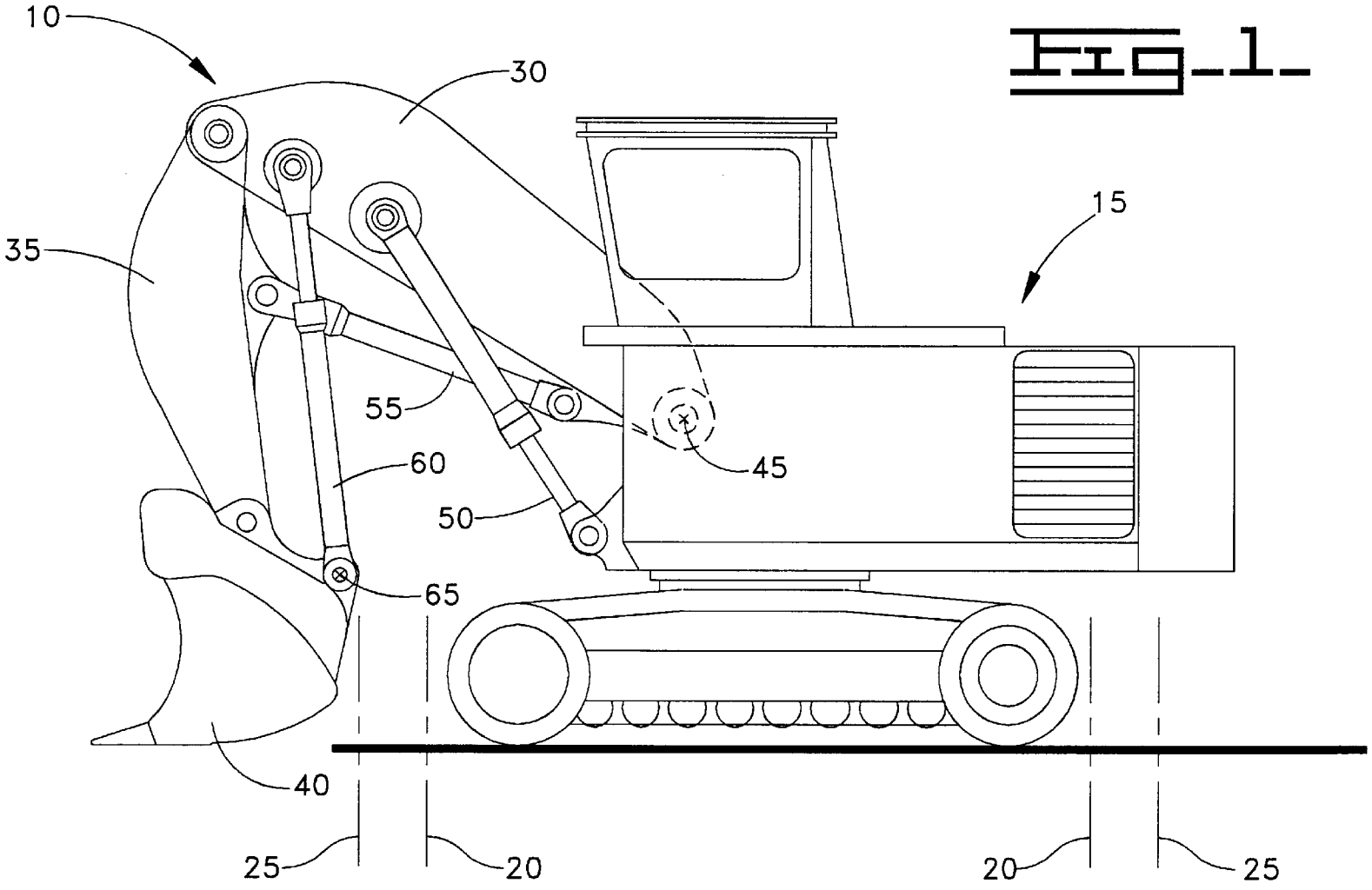
FIG. 1 is a diagrammatic side view of a work machine suitable for the invention.

FIG. 1 shows a side view of a work machine 15, in this case a track type mining shovel, an attached implement 10, a first boundary 20, and a second boundary 25. The implement 10 of the track work machine 15 includes a boom 30, a stick 35, and a bucket 40. The boom 30 is mounted on the work machine 15 by means of a boom pin 45. The stick 35 is connected to a free end of the boom 30, and the bucket 40 is attached to the stick 35. The boom 30, stick 35 and bucket 40 are independently and controllably actuated by respective linearly extendable hydraulic cylinders 50, 55, 60. The bucket 40 is directly actuated by the bucket hydraulic cylinder 60 and has a pivotal range of motion about a stick to bucket pivot pin 65.

The first boundary 20 is located around a portion of the work machine 15. The implement 10 is not permitted to enter the area between the first boundary 20 and the work machine 15. If desired, the second boundary 25 may be determined. The second boundary 25 is also located around a portion of the work machine 15. Between the first boundary 20 and the second boundary 25 is an area where a limited maximum speed of the implement 10 is engaged. The locations of the first and second boundaries, 20,25, shown in FIG. 1, are merely representative of possible locations. Other locations for the first and second boundaries, 20, 25 may also be determined.

Figure 2:
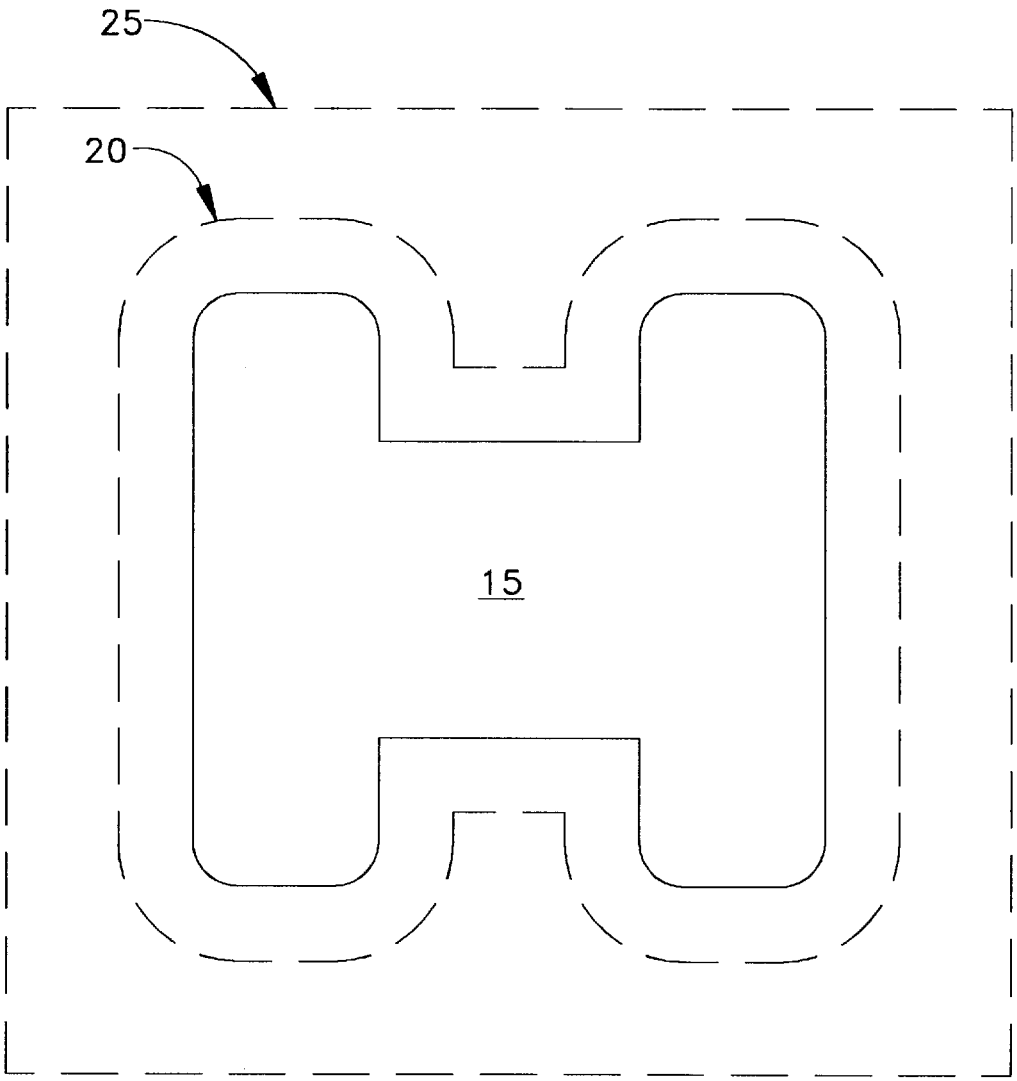
FIG. 2 is a diagrammatic top view of a work machine suitable for the invention.

Referring to FIG. 2, a diagrammatic top view of the work machine 15, the first boundary 20, and a second boundary 25 is shown. The relationship between the first and second boundaries, 20, 25 and the work machine 10 is the same as described for FIG. 1 above.

Figure 3:
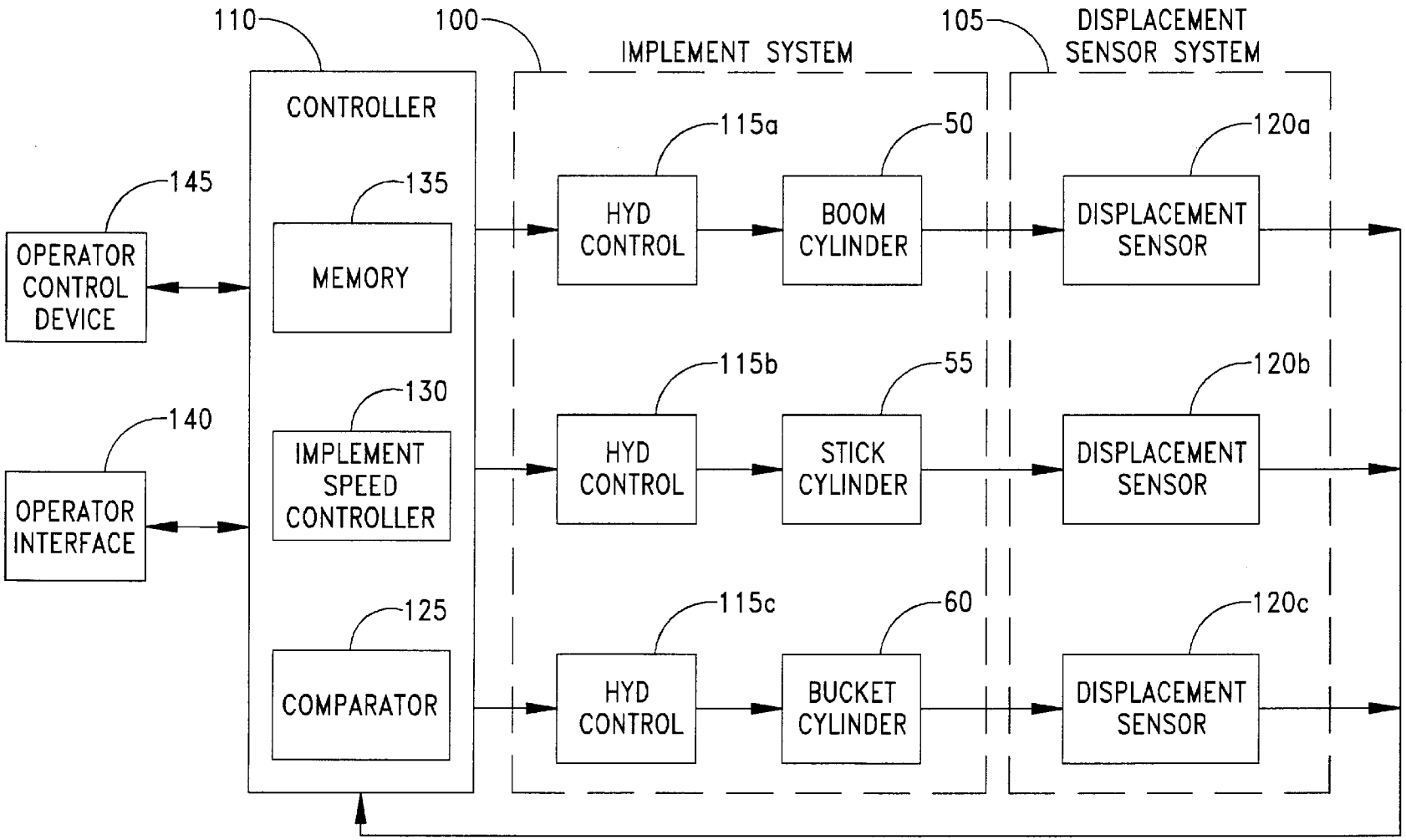
FIG. 3 is a functional block diagram of an embodiment of the invention.

Referring to FIG. 3, a functional block diagram of an embodiment of the invention, including an implement system 100, a displacement sensor system 105, and a controller 110, is shown. The implement system 100 includes hydraulic controllers 115*a,* 115*b,* 115*c,* and corresponding boom, stick, and bucket cylinders 50, 55, 60. The hydraulic controllers 115*a,* 115*b,* 115*c* controllably extend and retract the corresponding cylinders 50, 55, 60 in accordance with a desired position signal received from the controller 12. The displacement sensor system 105 is composed of one or more displacement sensors 120*a*, 120*b*, 120*c*. The displacement sensors typically sense the amount of piston extension in the boom, stick and bucket hydraulic cylinders 50,55, 60, and responsively produce sensed position of the implement signals. The controller 110 receives the sensed position of the implement signals as input from the displacement sensor system 105.

The controller 110 includes a comparator 125, an implement speed controller 130, and a memory 135. An input to the controller 110 is an operator control device 145. An optional input to the controller 110 is an operator interface 140.

The operator control device 145 provides manual control of the work implement 10. As is well known in the art, the desired position signal of the operator control device 145 represents the operator's desired movement of the implement 10. In the example of the work machine 15, the implementation of the operator control device 145 coordinates the movements of the boom 30, stick 35 and bucket 40 to conform to movements of the operator control device 145.

The comparator 125 compares the sensed position of the implement signal to the first boundary values, and responsively determines a prevent entry signal. If desired, the comparator 125 compares the sensed position of the implement signal to the second boundary values, and responsively determines a limit signal. The controller 110 will modify the desired position signal it delivers to the implement system 100 in accordance with the prevent entry signal or the limit signal. The implement system 100, in response to the desired position signal, adjusts the movements of the implement 10 by controlling hydraulic flow for the respective boom, stick and bucket hydraulic cylinders 50, 55, 60.

When the prevent entry signal indicates that the implement 10 is approaching the first boundary 20, the implement 10 is prevented from entering the area between the first boundary 20 and the work machine 15. In one embodiment of the invention, when the limit signal indicates that the implement 10 is between the second boundary 25 and the first boundary 20, a limited maximum speed signal is engaged. The memory 135 stores the values for the first boundary 20, the second boundary 25, and the limited maximum speed.

The values for the first boundary 20, the second boundary 25, and the limited maximum implement speed may be programmed at the factory, or may optionally be delivered to the controller 110 through an operator interface 140. The values will be stored in the memory 135. The operator interface 140 may be implemented by a programming tool (not shown), such as a lap top computer or a liquid crystal display screen with an alphanumeric key pad.

Industrial Applicability

Figure 4:
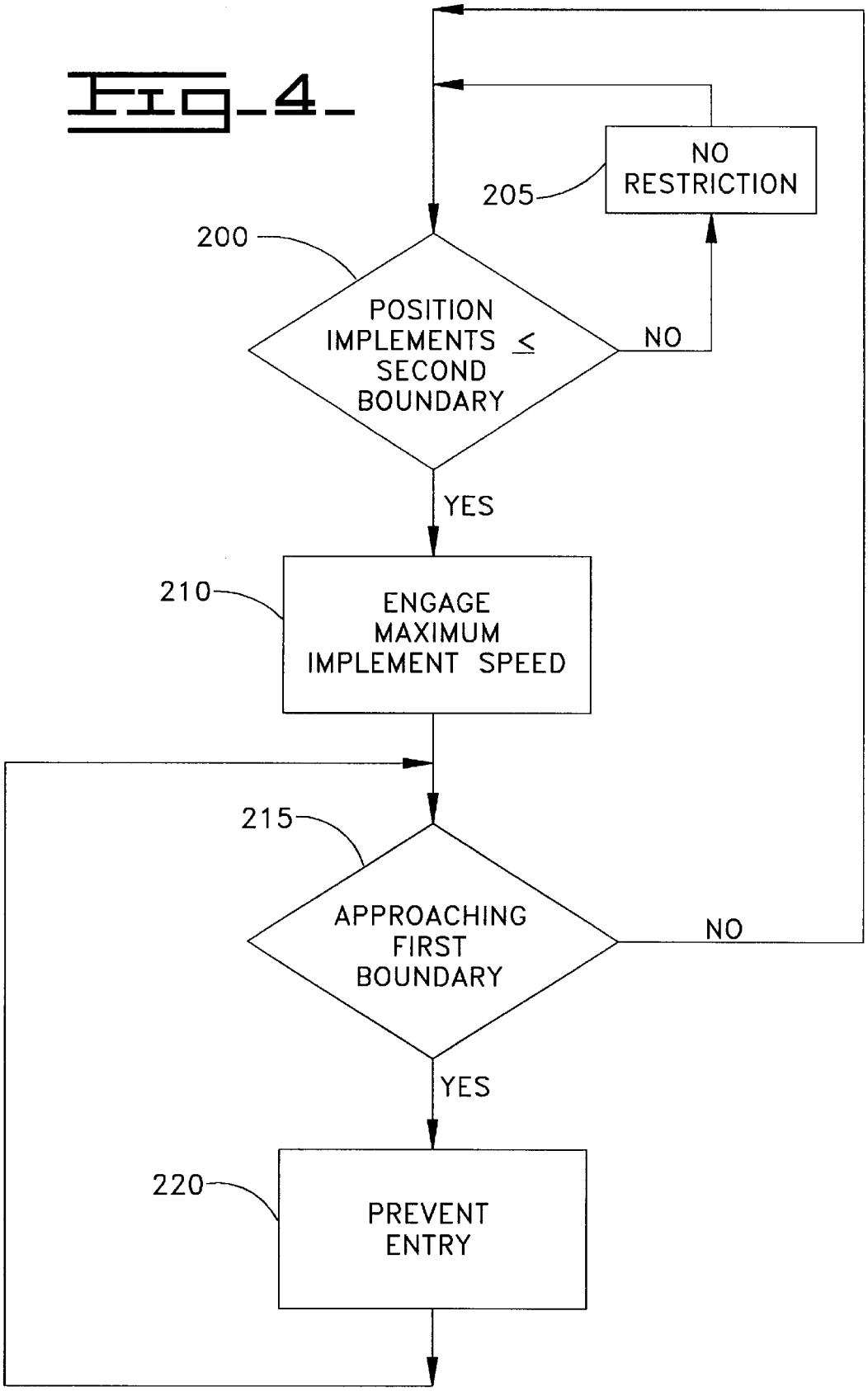
FIG. 4 is a flowchart illustrating the method of an embodiment of the invention.

The method for controllably restricting the movement and speed of an implement 10 of a work machine 15 is shown in the flowchart illustrated in FIG. 4. One embodiment is illustrated by the utilization of a first boundary 20 to prevent the implement 10 from striking the work machine 15. The first boundary 20 is located around a portion of the work machine 15. An optional second boundary 25 could also be utilized. The second boundary 25 is also located around a portion of the work machine 15. When the implement 10 is between the first boundary 20 and the second boundary 25, a limited maximum speed signal is engaged.

In the first decision block 200, the first boundary value is compared to the sensed position of the implement signal. If the position of the implement 10 is determined to be outside the second boundary 25, the control will pass to a first control block 205. At the first control block 205, no restriction will be placed on the movement of the implement 10. The control will continue looping from the first control block 205 to the first decision block 200 as long as the position of the implement 10 is determined to be outside the second boundary 25.

However, if the position of the implement 10 is determined to be at, or within, the second boundary 25, a limited maximum speed signal is engaged in a second control block 210. The limited maximum speed signal is utilized to limit the speed of the implement 10 by not allowing its movement to exceed a predetermined value.

Control passes to a second decision block 215, where the sensed position of the implement signal is compared to a first boundary value. In one embodiment, if it is determined that the implement 10 is not approaching the first boundary 25, control passes back to the first decision block 200. A loop is formed from the first and second decision blocks 200, 215, and the second control block 210. The limited maximum speed signal will remain engaged as long as the position of the implement 10 is determined by the control loop to be between the first and second boundaries 20, 25.

However, if the position of the implement 10 is determined, in the second decision block 21, to be approaching the first boundary 20, control is passed to a third control block 220. At the third control block 220, the implement 10 is prevented from entering the area between the first boundary 20 and the work machine 15. The control will continue looping from the third control block 220 to the second decision block 215 until it has been determined that the implement 10 is no longer approaching the first boundary 20.

We claim:

1. A method for controlling the movement of an implement relative to a work machine, the implement being connected with the work machine, wherein a controller produces a desired position signal and delivers the desired position signal to the implement, comprising:

establishing a first boundary relative to the work machine;

storing values as a function of the first boundary;

sensing a position of the implement with respect to the work machine;

determining a sensed position of the implement signal as a function of the sensed position;

comparing the sensed position of the implement signal with the first boundary values;

producing a prevent entry signal in response to the sensed position of the implement approaching the first boundary; and controllably modifying the desired position signal in the presence of the prevent entry signal to prevent the implement movement in a predetermined manner.

2. The method as set forth in claim 1, further comprising:

establishing a second boundary relative to the work machine;

storing second boundary values;

establishing a limited maximum speed signal;

storing the limited maximum speed signal in the memory;

comparing the sensed position of the implement signal with the second boundary values;

producing a limit signal in response to the implement penetrating the second boundary and continue producing the limit signal while the sensed position of the implement is between the first boundary and the second boundary; and controllably modifying the desired position signal in the presence of the limit signal and controllably engaging the limited implement speed signal for the duration of the limit signal.

3. A method for controlling the movement of an implement relative to a work machine, the implement being connected to the work machine, comprising:

establishing a first boundary having at least two dimensions around at least a portion of the work machine;

determining a position of the implement;

comparing the position of the implement with the first boundary; and preventing movement of the implement beyond the first boundary so as to prevent contact by the implement with the work machine.

4. The method of claim 3 wherein the first boundary is a predetermined distance from a surface of the work machine.

5. The method of claim 3, further comprising:

establishing a second boundary around at least a portion of the work machine;

determining a position of the implement with respect to the second boundary; and restricting the movement of the implement in response to the implement crossing the second boundary.

6. The method of claim 5 wherein the second boundary is a further distance from the work machine than the first boundary.

7. The method of claim 5 wherein the movement of the implement is restricted by limiting the speed of the implement.

8. An apparatus for restricting the movement of an implement that is coupled to a work machine, the work machine having an input device operable to generate a desired position signal corresponding to a desired position of the implement, and having an actuator coupled to the implement and to the input device to receive the desired position signal and operable to move the implement in response to receiving the desired position signal, comprising:

a memory operable to store at least one value corresponding to a predetermined first boundary having at least two dimensions, the first boundary being around at least a portion of the work machine and defining a non-interference zone around the portion of the work machine;

a position sensor coupled to the implement and operable to transmit an actual position signal corresponding to a position of the implement;

a controller coupled to the position sensor to receive the actual position signal and to the memory to read the at least one value corresponding to the first boundary, the controller operable to prevent the actuator from moving the implement into the non-interference zone in response to the actual position signal having a predetermined relationship with respect to the at least one value corresponding to the first boundary.

9. The apparatus of claim 8 wherein the predetermined first boundary surrounds a cross-section of the work machine.

10. The apparatus of claim 8 wherein the predetermined first boundary encloses at least a part of the work machine.

11. The apparatus of claim 8 wherein the controller is coupled between the input device and the actuator to receive the desired position signal from the input device and to transmit the desired position signal to the implement, and the controller prevents the actuator from moving the implement into the non-interference zone by modifying the desired position signal in response to the implement position signal having the predetermined relationship with respect to at least one of the at least one value corresponding to the first boundary.

12. The apparatus of claim 8 wherein:

the memory is further operable to store at least one value corresponding to a predetermined second boundary, the second boundary being around at least a portion of the work machine; and the controller is coupled to the memory to read at least one of the at least one value corresponding to the second boundary, and the controller is operable to limit the speed of the movement of the implement via the actuator in response to the actual position signal having a predetermined relationship with respect to at least one of the at least one value corresponding to the second boundary.

13. The apparatus of claim 12 wherein the predetermined second boundary surrounds a cross-section of the work machine.

14. The apparatus of claim 12 wherein the predetermined second boundary encloses at least a part of the work machine.

15. The apparatus of claim 12 wherein the second boundary is further than the first boundary in a direction normal to a surface of the work machine.

* * * * *